US008618940B2

(12) United States Patent
Ford et al.

(10) Patent No.: US 8,618,940 B2
(45) Date of Patent: Dec. 31, 2013

(54) WATER ACTIVATED SAFETY LIGHT AND FLOTATION DEVICE USING

(75) Inventors: Timothy D. F. Ford, Beaconsfield (CA); Stephane Gascon, Mascouche (CA)

(73) Assignee: The Flewelling Ford Family Trust, Beaconsfield (CA)

( * ) Notice: Subject to any disclaimer, the term of this patent is extended or adjusted under 35 U.S.C. 154(b) by 1042 days.

(21) Appl. No.: 12/646,378

(22) Filed: Dec. 23, 2009

(65) Prior Publication Data

US 2010/0097230 A1 Apr. 22, 2010

Related U.S. Application Data

(62) Division of application No. 11/682,499, filed on Mar. 6, 2007, now Pat. No. 7,714,730.

(60) Provisional application No. 60/778,929, filed on Mar. 6, 2006.

(51) Int. Cl.
*G08B 23/00* (2006.01)

(52) U.S. Cl.
USPC ..... 340/573.6; 340/984; 340/604; 362/158; 362/194

(58) Field of Classification Search
USPC ..... 340/573.6, 573.1, 984, 604; 362/84, 362/158, 194, 205, 208; 441/11, 12, 18, 36, 441/83, 89
See application file for complete search history.

(56) References Cited

U.S. PATENT DOCUMENTS

| | | | | |
|---|---|---|---|---|
| 4,070,145 | A * | 1/1978 | Hall et al. | 431/359 |
| 5,034,847 | A | 7/1991 | Brain | |
| 5,311,100 | A * | 5/1994 | Brain | 315/129 |
| 5,452,189 | A * | 9/1995 | Alkj r | 362/253 |
| 6,183,328 | B1 | 2/2001 | Marshall | |
| 6,925,654 | B2 * | 8/2005 | De Silva | 2/108 |
| 7,056,179 | B2 | 6/2006 | Courtney | |
| 7,195,369 | B2 * | 3/2007 | Shaw | 362/108 |
| 2004/0129311 | A1 * | 7/2004 | Courtney | 137/223 |
| 2008/0205049 | A1 | 8/2008 | Brain | |
| 2008/0310149 | A1 | 12/2008 | Chan | |

* cited by examiner

*Primary Examiner* — Hung T. Nguyen
(74) *Attorney, Agent, or Firm* — Goudreau Gage Dubuc; Hugh Mansfield

(57) ABSTRACT

There is disclosed a flotation device such as a life vest or inflatable raft for keeping a user afloat when in water, the flotation device comprising a light source attached to the flotation device, a water activated switch, wherein the light source is illuminated when the water activated switch is submersed in the water, and a control panel mounted to an outer surface of the flotation device and comprised of at least one user activated switch, wherein the light source is extinguished when the user activated switch is depressed, the control panel having instructions printed thereon.

7 Claims, 5 Drawing Sheets

22
26
32
38
24
44
V
40
46
28
42

WATER ACTIVATED SAFETY LIGHT AND FLOTATION DEVICE USING

CROSS REFERENCE TO RELATED APPLICATIONS

This application is a Divisional Application of U.S. patent application Ser. No. 11/682,499 filed on Mar. 6, 2007, now U.S. Pat. No. 7,714,730, which claims benefit of U.S. Provisional Application No. 60/778,929 filed on Mar. 6, 2006 the entirety of which is incorporated herein by reference

FIELD OF THE INVENTION

The present invention relates to a water activated safety light and flotation device, such as a life vest or life raft, using same. In particular, the present invention relates to a water activated safety light with manual override including a switch pad to switch between two or more user modes.

BACKGROUND TO THE INVENTION

Persons who become stranded in large bodies of water due to boat mishaps or the like are in the best of circumstances difficult to locate. This situation is aggravated by the onset of wave action or darkness which can severely hamper rescue efforts, especially if these are being carried out from the air and over large areas. Additionally, even if a person is equipped with a suitable life vest which ensures that he/she stays afloat even while unconscious, as the onset of hypothermia in even relatively warm bodies of water can be fairly rapid, failure to locate and extract survivors from the water quickly can have dire results.

In order to improve the visibility of a person stranded in water the prior art reveals signalling devices comprising a small yet bright light source and battery pack. These are often fastened to the life vest by means of a lanyard or the like, and float, or are mounted directly on the upper part of the life vest and typically generate a flashing signal, or strobe. Additionally, such prior art devices often include a submersible switch which activates the flashing light source when the switch is placed in water. Such water activated switches are advantageous in settings where the wearer of the life vest is unconscious or otherwise unable operate the light source on his or her own (for example, as in the case of small children or infants). One drawback of these prior art devices is that they only function when in contact with water. Another drawback of these prior art devices is that no means are provided to extinguish the light source (for example, during daytime when the light is more or less invisible) and as a result, the batteries of such prior art devices become quickly depleted.

In order to overcome these drawbacks, means, such as a toggle switch, are provided in the prior art allowing the wearer to deactivate the light source, for example during the day when the visibility of the light source is adversely affected by the ambient light, thereby allowing the wearer to preserve the signalling device's battery pack.

One drawback of these prior art devices is that the toggle switch is easy to engage, which in some cases may lead to the flashing light source being inadvertently disconnected from the battery pack. Still another drawback is that such prior art devices uses either incandescent bulbs which are inherently fragile, or zenon strobes which are not suitable for use as steady state light sources. One other drawback is that if the flashing light source is deactivated using the toggle switch and the wearer leaves the water for a period of time, the water activated switch does not reactivate the flashing light source.

As a result, if the wearer subsequently re-enters the water, the flashing light source will not be illuminated.

SUMMARY OF THE INVENTION

In order to address the above and other drawbacks, there is provided a method for changing a mode of a light source attached to a flotation device and comprised of at least one light from a first mode to a second mode. The method comprises providing a control panel on the flotation device, wherein the panel is accessible and wherein the control panel comprises at least two switches, and depressing the switches substantially simultaneously.

There is also provided a method for user control of a light source, the light source adapted for use with a conductive fluid. The method comprises providing a water activated switch and at least one user activated switch, illuminating the light source when the water activated switch is submersed in the conductive fluid, extinguishing the light source when the at least one user activated switch is depressed by the user, removing the water activated switch from the conductive fluid for a period of time and resubmersing the water activated switch in the conductive fluid. When the light is illuminated following the resubmersing act provided the period of time is greater than a predetermined period of time.

Additionally, there is provided a flotation device comprising a light source attached to the flotation device, a water activated switch, wherein the light source is illuminated when the water activated switch is submersed in the water and a control panel comprised of at least one user activated switch. When the light source is extinguished when the user activated switch is depressed, the control panel having instructions printed thereon.

DETAILED DESCRIPTION OF THE ILLUSTRATIVE EMBODIMENTS

Figure 1:
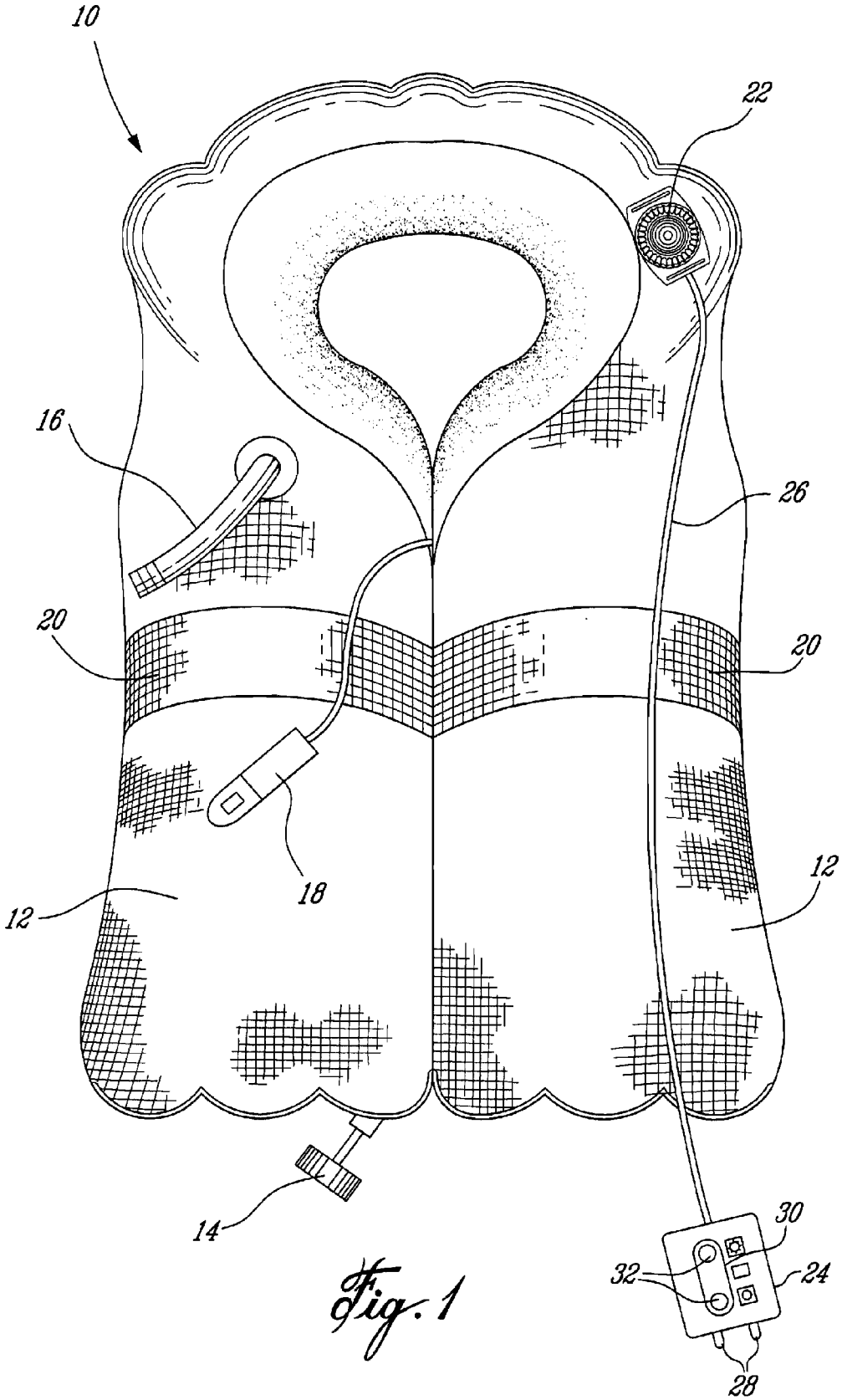
FIG. 1 is a front view of a life vest according to an illustrative embodiment of the present invention.

Referring now to FIG. 1, a life vest in accordance with an illustrative embodiment of the present invention, and generally referred to using the reference numeral 10, will be described. The life vest 10 is comprised of one or more chambers as in 12 which are filled with a buoyant material (not shown). In the case of an inflatable vest, the buoyant material is a gas, such as $CO_2$ or air, which is introduced into the chamber(s) from a cylinder or the like (not shown), typically activated by means of a rip cord 14. Additionally, a back up oral inflation tube 16 is provided in order to maintain buoyancy or inflate the vest 10 when the cylinder is empty or inoperable.

Still referring to FIG. 1, in order to improve a wearer's chances of being discovered, the outer visible part of the life vest 10 is typically manufactured from a bright material in yellow or day-glow orange. Additionally, the life vest 10 is equipped with a whistle 18 for generating an audible signal, reflective strips as in 20 and a light source 22.

Figure 2:
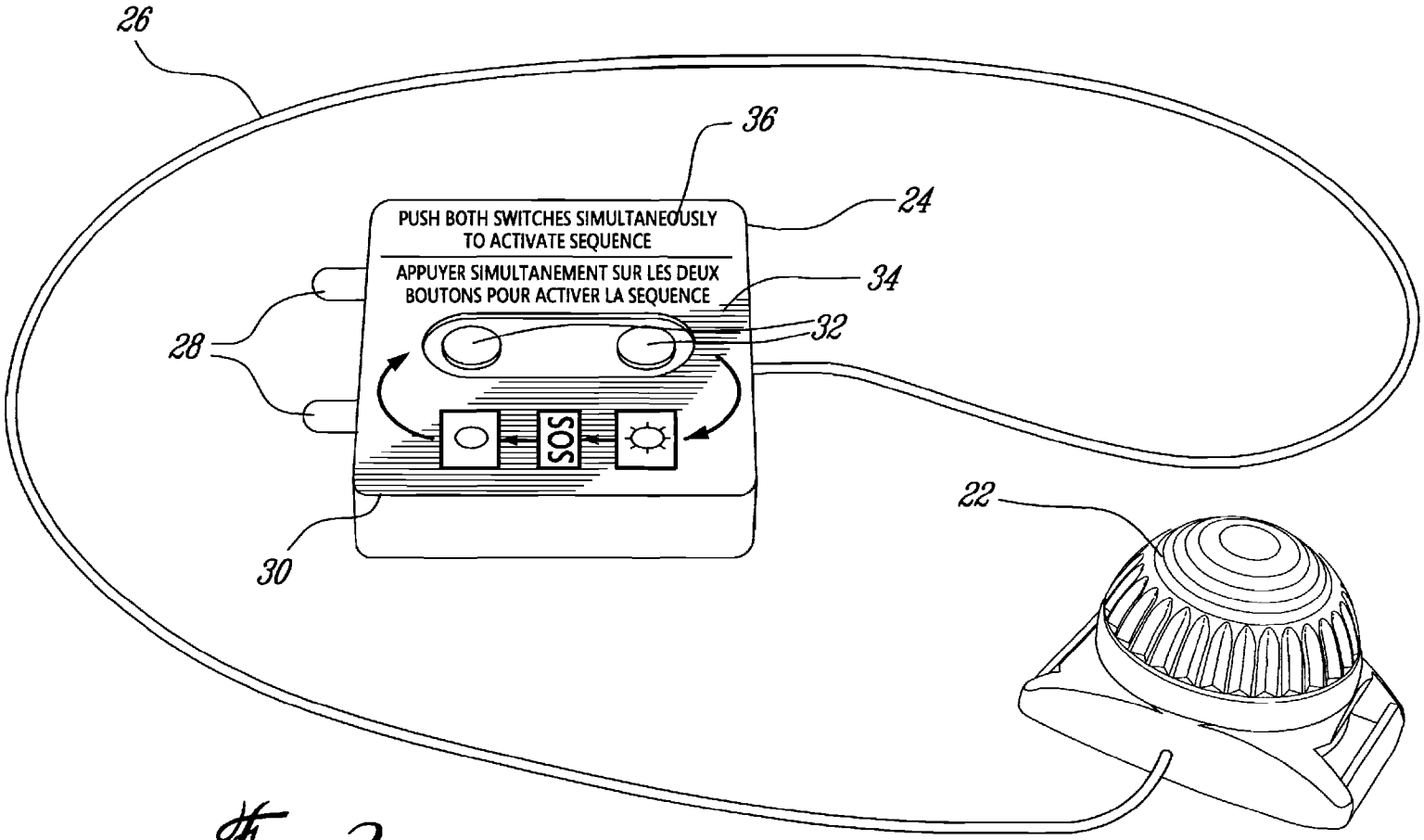
FIG. 2 is a raised front view of a light source, battery pack and control module according to an illustrative embodiment of the present invention.

Referring now to FIG. 2 in addition to FIG. 1, the light source 22 is interconnected with a water proof battery pack 24 via an insulated electrical cable 26 which provides power to drive the light source 22. Given its relatively heavy weight, the battery pack 24 has a tendency to sink when placed in water and as a result provides a useful location for a water activated switch 28. Additionally, the battery pack 24 also provides a useful location for a control panel 30 comprised of one or more user activated switches as in 32. In this regard, the control panel 30 and battery pack 24 are illustratively integrated into the same sealed enclosure, for example manufactured from rubber, plastic or the like. The control panel 30 typically comprises a printable surface 34 onto which instructions as in 36 on how to operate the light (typically in the form of easy to understand pictograms) are printed. The sensor probes of the water activated switch 28 are illustratively placed a distance apart in order to ensure that water drops or vapour will not accidentally trigger the water activated switch 28.

Of note is that, in an alternative illustrative embodiment, the switches as in 32 could be mounted along the insulated electrical cable 26, for example at a height which is more readily reachable by the user. Additionally, in a particular embodiment the control panel 30 is comprised of two (2) switches positioned apart such that the wearer of the life vest 10 (or another) can manipulate the switches even when the wearers hands are hampered by clothing such as survival gloves or the like (not shown). In this regard, it is foreseen that the wearer would grasp the control panel in both hands and manipulate the two (2) switches simultaneously using both thumbs.

Figure 3:
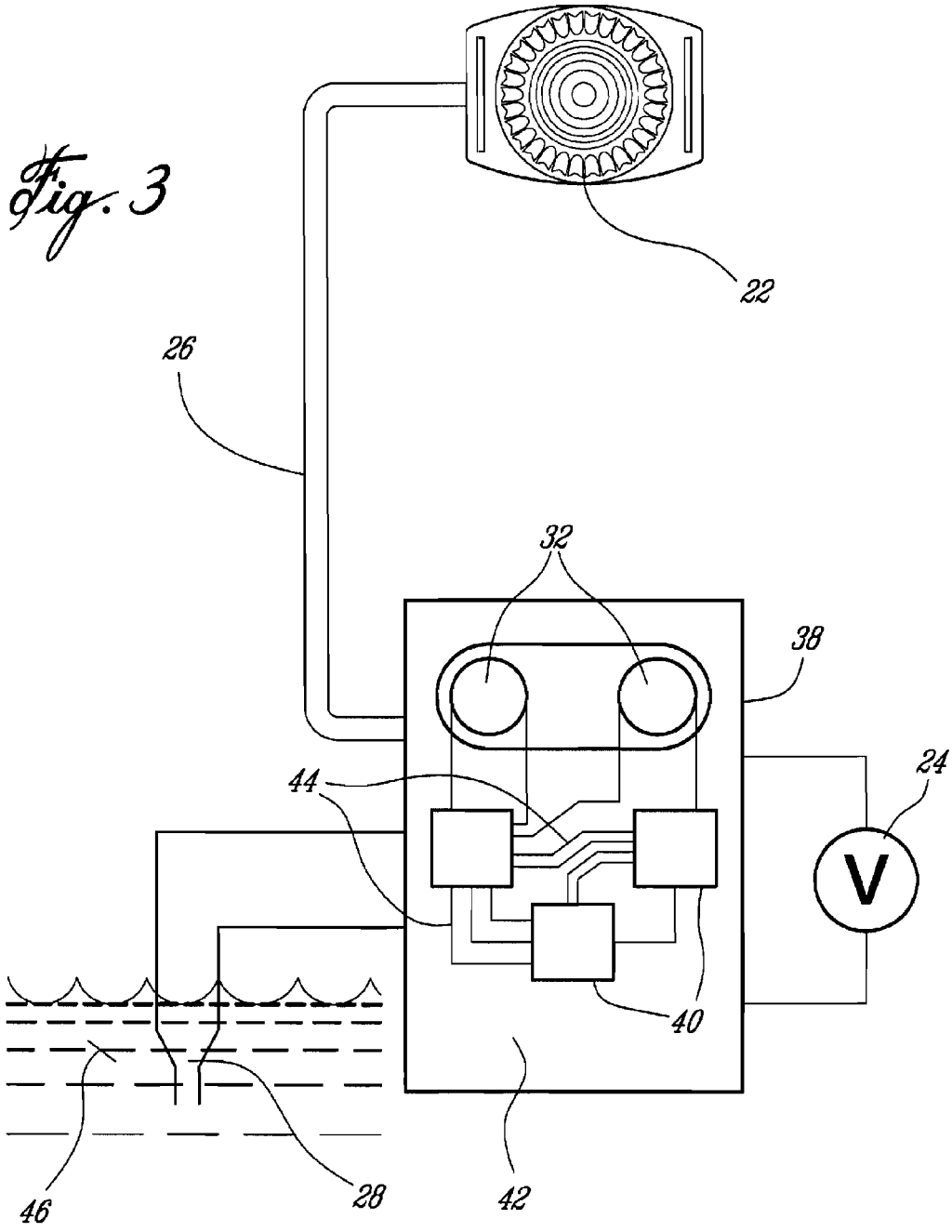
FIG. 3 is a schematic diagram of a control module for controlling alight source according to an illustrative embodiment of the present invention.

Referring now to FIG. 3, the switches as in 32 are interconnected with a control module 38 comprised of electronics as in 40, for example resistors, capacitors, oscillators, integrated circuits and the like, mounted on a printed circuit board (PCB) 42 and interconnected by a plurality of conductive traces as in 44. The PCB 42 can comprise either a conventional rigid substrate or, alternatively, a flexible material such as polymide can be used as substrate, thereby providing for a circuit board which is to some degree pliable. A pliable construction may be advantageous in certain applications, for example where the printable surface 34 of the control panel 30 is uneven or irregular, or must be able to bend. For example, in a particular embodiment the control panel 30 can be applied directly to the surface of the life vest 10, for example using a suitable adhesive. As the life vest 10 once inflated typically has a slightly rounded outer surface, but is typically stored flat and folded, it will now be apparent to a person of skill in the art that the ability of the control panel 30 to adapt to the changing shape of the life vest 10 in this application can be of advantage.

The light source 22 is illustratively at least one high power LED which is suitable as both a flashing and a steady state light source. Additionally, such high power LEDs are available in a variety of colours as well as infra red, and as a result it is foreseeable that a combination of different colours be included in order to provide a variety of illuminating schemes.

Referring back to FIG. 1 in addition to FIG. 3, the printable surface 32 of the control panel 30 is typically covered with a fabric covering or the like (not shown) onto which instructions on how to operate the light (typically in the form of easy to understand pictograms) are printed, thereby allowing a wearer who is unfamiliar with the life vest 10 to understand and correctly operate the light 22. Additionally, the printable surface 32 is illustratively integrated into and mounted flush with the outer surface of the battery pack 24 (although in one alternative embodiment the printable surface 32 could be integrated into the fabric and the surface of the life vest 10).

Still referring to FIG. 3, using power supplied by the battery pack 24, the control module 30 senses when the water activated switch 28 is submersed in a conductive fluid such as water 46 and illuminates the light source 22 according to predetermined instructions coded into the electronics 40 or based on commands received from the wearer via the switch(es) as in 32. In typical operation, the light source 22 is automatically illuminated when the water activated switch 28 is submersed. In operation, the control module 30 would typically drive the light 22 as a strobe, or according to a predetermined flashing sequence, for example the well known Morse code representation of SOS. Additionally, the electronics as in 40 would continue to drive the light source 22 in this manner even after the water activated switch 28 is removed from the water 46.

Still referring to FIG. 3, as discussed above the control panel 30 is provided with at least one switch as in 32, which may be used to control the electronics as in 40 and, for example, illuminate or extinguish the light source 22 or change the mode of illumination of the light source 22. For example, a switch as in 32 may be used to change the light source 22 from strobe to steady state, or from strobe to a particular signalling sequence, such as the Morse code representation of SOS as discussed above. Typically, continued pressing of the switch(es) 32 would cause the control module 30 to cycle the light source 22 through its different modes. In a particular illustrative embodiment, the control panel 30 is provided with two (or more) switches as in 32 which must be simultaneously depressed in order to illuminate or extinguish the light source 22, or change its mode of illumination. In this regard, a dual switch configuration guards against the light source 22 being inadvertently deactivated, for example by brushing a switch as in 32 against a foreign object (not shown).

Still referring to FIG. 3, as discussed above the electronics as in 40 would continue to drive the light source 22 for some time (typically for several seconds or minutes) or indefinitely after the water activated switch 28 is removed from the water 46, thereby providing for continuous operation of the light source 22, for example in cases of heavy wave action or the like. Turning the light source 22 off, however, when the water activated switch 28 is submersed would indicate to the electronics as in 40 that the water activated switch 28 is to be completely deactivated. As a result, the light source would not be re-illuminated, even if the water activated switch 28 is removed from the water 46 for an extended period of time and then re-submersed. However, turning the light source 22 off when the water activated switch 28 is no longer submersed would indicate to the electronics as in 40 that the water activated switch 28 is not to be deactivated. As a result, the light source would be re-illuminated in the event the water activated switch 28 is re-submersed in water 46.

In another illustrative embodiment, removal of the water activated switch 28 from the water for an extended period of time (typically several minutes or hours) causes the control module 30 to automatically be reset. This is advantageous, for example, when the light source 22 has been deactivated by the user and subsequently the life vest 10 is dried and stored for later re-use. In another illustrative embodiment, deactivation of the light source 22 by the user would cause the light source to be deactivated only for a limited period of time, for example one (1) hour at which point the electronics as in 40 would commence once again to illuminate the light source.

Figure 4:
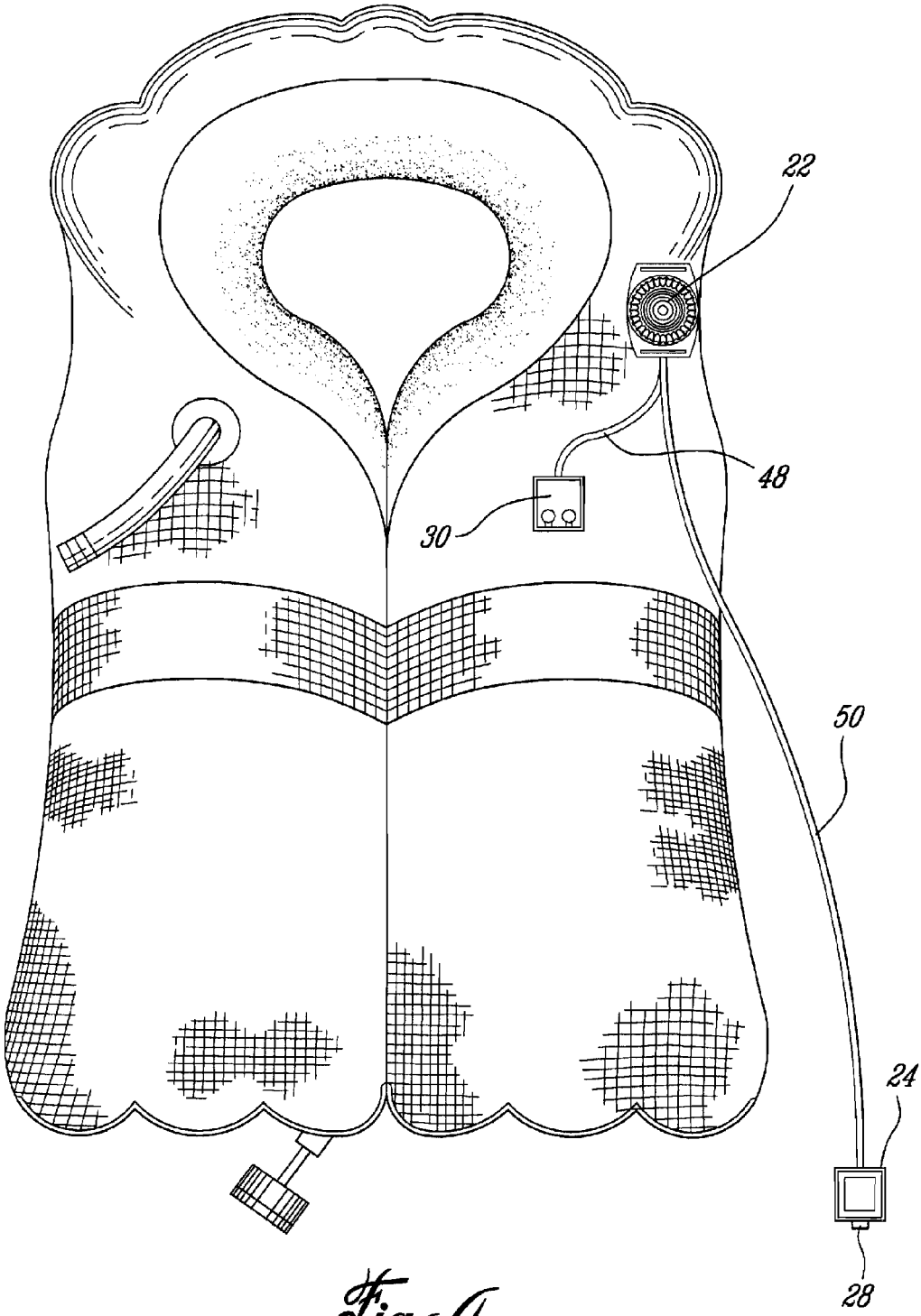
FIG. 4 is a front view of a life vest according to an alternative illustrative embodiment of the present invention.

Referring now to FIG. 4, in still another illustrative embodiment the control panel 30 is separated from the battery pack 24 mounted flush on the surface of one of the inflatable chambers as in 12 of the life vest 10 and interconnected with the light source 22 by an insulated electrical cable 48. Again, the battery pack 24 is combined with the water activated switch 28 and attached to the light source 22 via a second insulated electrical cable 50. In this regard, the battery back 24 again provides the requisite ballast necessary for keeping the water activated switch 28 submerged. In a particular embodiment the battery pack 24/water activated switch 28 assembly is detachable. As life vests are often stowed for many years without being used, provision of a detachable battery pack 24 in this manner allows the battery pack 24 to be easily replaced with a fresh battery pack 24 on a regular basis (for example every five (5) years) in order to ensure that the battery pack 24 is fresh when the life vest 10 is eventually used.

Additionally, the instructions as described hereinabove could be printed either on the control panel 30, or alternatively on the outer surface of the battery pack 24. In a particular embodiment the control panel 30 would be mounted on the inflatable chamber as in 12 using Velcro™ thereby allowing the control panel to be removed for easier viewing of the instructions imprinted thereon and easier manipulation by the wearer of the life vest 10 (or another).

Figure 5:
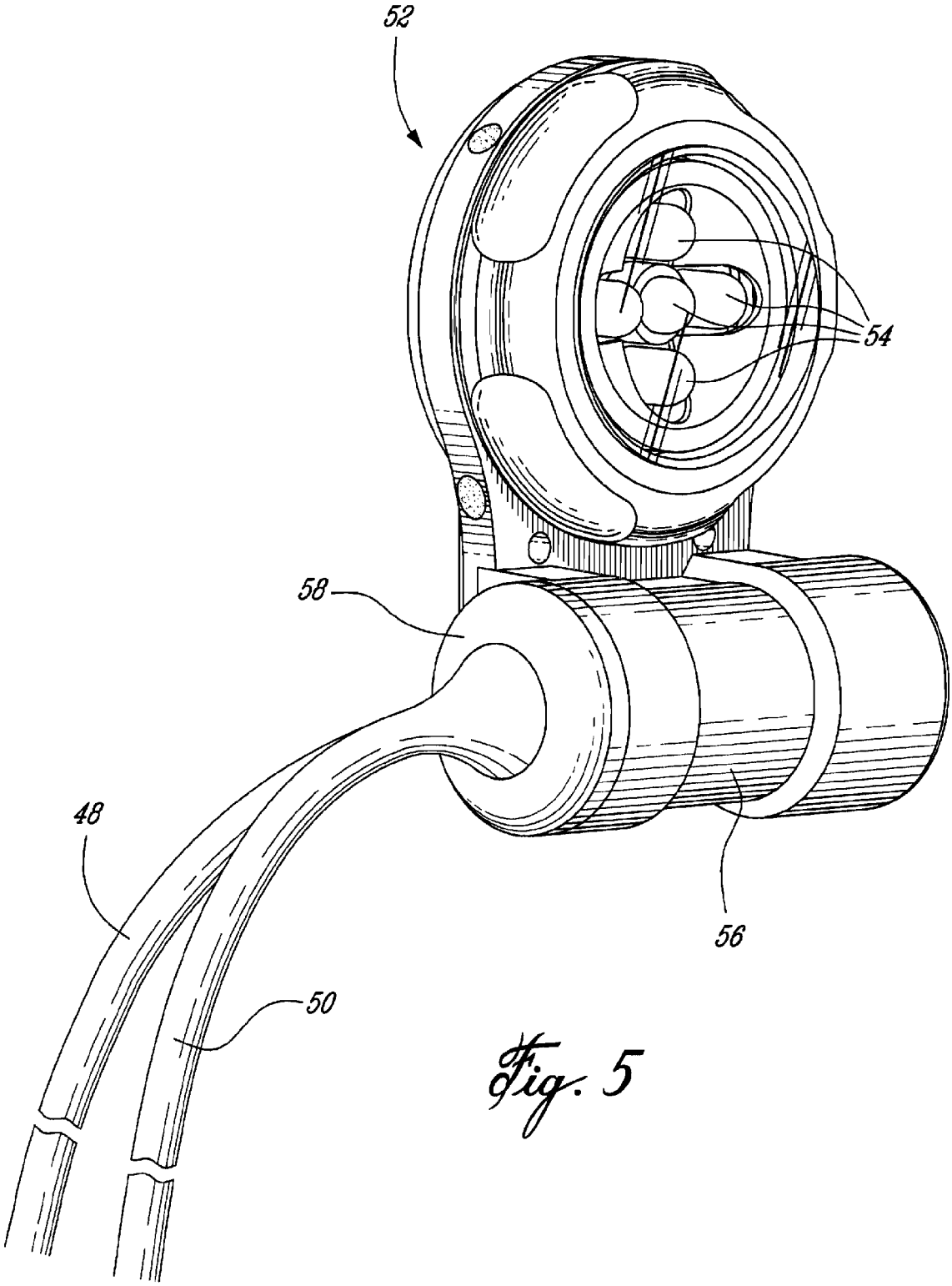
FIG. 5 is a side perspective view of an alternative light source for use with the battery back and control module of the present invention.

Referring now to FIG. 5 in addition to FIG. 4, in an alternative illustrative embodiment of the present invention the light 22 can be replaced by an alternative light source 52 comprising one or more LEDs 54 and a battery compartment 56 covered with a suitably adaptor cap 58. The adaptor cap 58 provides the interconnections and electronics necessary to interconnect the control panel 30 via the insulated electrical cable 48 with the battery (not shown) within the battery compartment 56 thereby allowing for control of the illumination of the LEDs 54. Additionally, the battery pack 24 connected with the adaptor cap 58 the insulated electrical cable 50 can be replaced by a weighted water activated switch 28 or can be used to supplement the battery within the battery compartment 56.

Of note is that although the above light source 22, control panel 30 and battery pack 24/water activated switch 28 are shown used in conjunction with a live vest, the light source 22, control panel 30 and battery pack 24/water activated switch 28 could also be used in conjunction with other floatation devices such as inflatable rafts and the like.

It is to be understood that the invention is not limited in its application to the details of construction and parts illustrated in the accompanying drawings and described hereinabove. The invention is capable of other embodiments and of being practised in various ways. It is also to be understood that the phraseology or terminology used herein is for the purpose of description and not limitation. Hence, although the present invention has been described hereinabove by way of preferred embodiments thereof, it can be modified, without departing from the spirit, scope and nature of the subject invention as defined in the appended claims.

What is claimed is:

1. A method for changing a mode of a light source attached to a flotation device and comprised of at least one light from a first mode to a second mode, the method comprising:

providing a control panel on the flotation device, wherein said panel is accessible and wherein said control panel comprises at least two switches; and depressing said switches substantially simultaneously.

2. The method of claim 1, wherein the first mode is a normally illuminated mode wherein said at least one light flashes regularly and wherein the second mode is an extinguished mode wherein said at least one light is no longer illuminated.

3. The method of claim 1, wherein the flotation device is a life vest and said control panel is placed on a front surface of the vest.

4. The method of claim 1, wherein said providing act comprises fastening said control panel to the flotation device.

5. The method of claim 1, wherein said control panel is substantially flexible and said providing act comprises bonding said control panel to the flotation device with an adhesive.

6. The method of claim 1, wherein at least a portion of the flotation device is manufactured from a fabric and wherein said control panel is integrated into said fabric.

7. The method of claim 1, wherein said control panel is flush with a surface of the flotation device.

* * * * *